US007308796B1

(12) United States Patent
Eager

(10) Patent No.: US 7,308,796 B1
(45) Date of Patent: Dec. 18, 2007

(54) FRUIT REFRIGERATOR

(76) Inventor: Jacob P. Eager, 2606 Arabian Ranch La., Vista, CA (US) 92084

( * ) Notice: Subject to any disclaimer, the term of this patent is extended or adjusted under 35 U.S.C. 154(b) by 199 days.

(21) Appl. No.: 11/338,497

(22) Filed: Jan. 25, 2006

Related U.S. Application Data

(60) Provisional application No. 60/686,747, filed on Jun. 3, 2005.

(51) Int. Cl.
*F25B 21/02* (2006.01)
*F17C 13/00* (2006.01)

(52) U.S. Cl. ..... 62/3.2; 62/3.6; 62/457.9

(58) Field of Classification Search ..... 62/3.2, 62/3.4, 3.6, 3.62, 3.7, 3.3, 371, 407, 408, 62/411, 440, 452, 457.6, 457.7, 457.9
See application file for complete search history.

(56) References Cited

U.S. PATENT DOCUMENTS 2,943,452 A 7/1960 Buchanan
3,194,023 A 7/1965 Suchmeier
3,823,567 A 7/1974 Corini
4,311,017 A * 1/1982 Reed et al. ..... 62/3.64
4,326,383 A 4/1982 Reed
5,060,479 A * 10/1991 Carmi et al. ..... 62/3.62
5,456,164 A 10/1995 Bang
5,718,124 A * 2/1998 Senecal ..... 62/457.6
5,782,094 A 7/1998 Freeman
5,941,077 A * 8/1999 Safyan ..... 62/3.3
5,987,891 A * 11/1999 Kim et al. ..... 62/3.6
6,260,360 B1 7/2001 Wheeler
6,295,820 B1 * 10/2001 Cauchy et al. ..... 62/3.6
6,422,024 B1 * 7/2002 Foye ..... 62/3.2
6,619,045 B1 * 9/2003 Clark ..... 62/3.6
6,651,445 B1 * 11/2003 Clark et al. ..... 62/3.6
6,658,858 B1 * 12/2003 Thompson et al. ..... 62/3.6
6,763,665 B2 * 7/2004 Clark et al. ..... 62/3.6
6,799,433 B1 * 10/2004 Gleason et al. ..... 62/457.9
7,246,505 B2 * 7/2007 Navedo et al. ..... 62/420

FOREIGN PATENT DOCUMENTS

JP 8-264693 A * 10/1996

* cited by examiner

*Primary Examiner*—Mohammad M. Ali
(74) *Attorney, Agent, or Firm*—Allen A. Dicke, Jr.

(57) ABSTRACT

The fruit refrigerator has a cold plate which is cooled by a thermal electric unit secured underneath. Power is supplied to the thermal electric unit and to a cooling fan which blows air over the thermal electric unit. The cold plate has a depressed center, and liquid drains down through a wick. The cold plate has a transparent cover. A circulating fan on the cold plate prevents stratification within the domed cover and helps equalize cooling of fruit on the tray.

18 Claims, 2 Drawing Sheets

FRUIT REFRIGERATOR

CROSS-REFERENCE

This application relies for priority on my Provisional Application Ser. No. 60/686,747, filed Jun. 3, 2005.

BACKGROUND OF THE INVENTION

The present distribution system for perishable foodstuffs, such as fruit, delivers almost ripe fruit for retail sale. A particular example of the fruit delivery system is the one for bananas. The time to ripeness of a banana is closely related to the environmental temperature. The temperature is regulated so that the bananas reach the proper state at each step of the distribution process. When the bananas reach the fruit retailer, they are ready to be exposed to the ambient temperature and are promptly sold. When the ambient temperature is in the comfortable range of 75 degrees F., the bananas are now ready to be eaten and become overripe in three or four days. Time and temperature are closely related in the maturity of bananas.

Other fresh fruits are also sold just before time and temperature have brought them to full ripeness. Sometimes several days at ambient temperatures are necessary to bring these other fruits, such as pitted fruits, to optimum temperature for eating. When such fruits have reached their optimum ripeness, they must also be refrigerated below room temperature in order to limit the speed of further ripening. Thus, there is need for a refrigerator which maintains fruit at a temperature below room ambient so that further ripening of the fruit is reduced by lower temperature.

A prior structure configured to store and ripen table fruit is configured to blowing air from a cooler section into the food holding section. This type of system results in more space being dedicated to the equipment and less space being available for fruit holding, than in a comparable sized structure using cold plate technology. In such a structure, the air holes from the cooler section to the fruit holding section may be covered by the fruit, thus reducing air flow and cooling capacity. This disadvantage is overcome by cooling the plate on which the fruit rests rather than bringing in cool air from the cooling device. In addition, in order to provide substantial uniformity of the air temperature in the environment in which the fruit is stored, it is desirable to circulate air around the fruit, with the circulating air being cooled by the cold plate.

SUMMARY OF THE INVENTION

In order to aid in the understanding of this invention, it can be stated in essentially summary form that it is directed to a fruit refrigerator which includes a refrigerated cold plate to hold the fruit and a dome over the fruit to provide a space for the fruit which is below room ambient temperature. The cold plate is cooled by any convenient means, such as a thermoelectric cooler. A cold air circulator is provided over the cold plate to circulate the chilled air in the closed space above the cold plate under the dome.

It is, thus, a purpose and advantage of this invention to provide a fruit refrigerator into which substantially ripe fruit can be introduced so that the fruit is held at a temperature below room temperature in order to maintain the fruit at a reduced temperature to delay its time of over-ripening.

It is another purpose and advantage of this invention to provide a fruit refrigerator for the receipt of fruit which is ready to eat, wherein the fruit refrigerator is decorative so that it can be placed on a counter or table so that an attractive presentation of the ready-to-eat fruit is provided.

It is another purpose and advantage of this invention to provide a fruit refrigerator which is powered by a structurally simple cooler so that the refrigerator may be made small enough to be a counter top device for the refrigeration and display of the fruit.

It is another purpose and advantage of this invention to provide a fruit refrigerator which has a cold plate upon which the fruit is placed for cooling and display with the cold plate being mounted on the cooler to be directly chilled, and there is a circulating fan in the enclosed space above the cold plate to circulate the chill around the fruit.

It is another purpose and advantage of this invention to provide a fruit refrigerator which is economic of construction so that it might be widely used and enjoyed.

Other purposes and advantages of this invention will become apparent from a study of the following portion of the specification, the claims and the attached drawings.

DESCRIPTION OF THE PREFERRED EMBODIMENT

Figure 1:
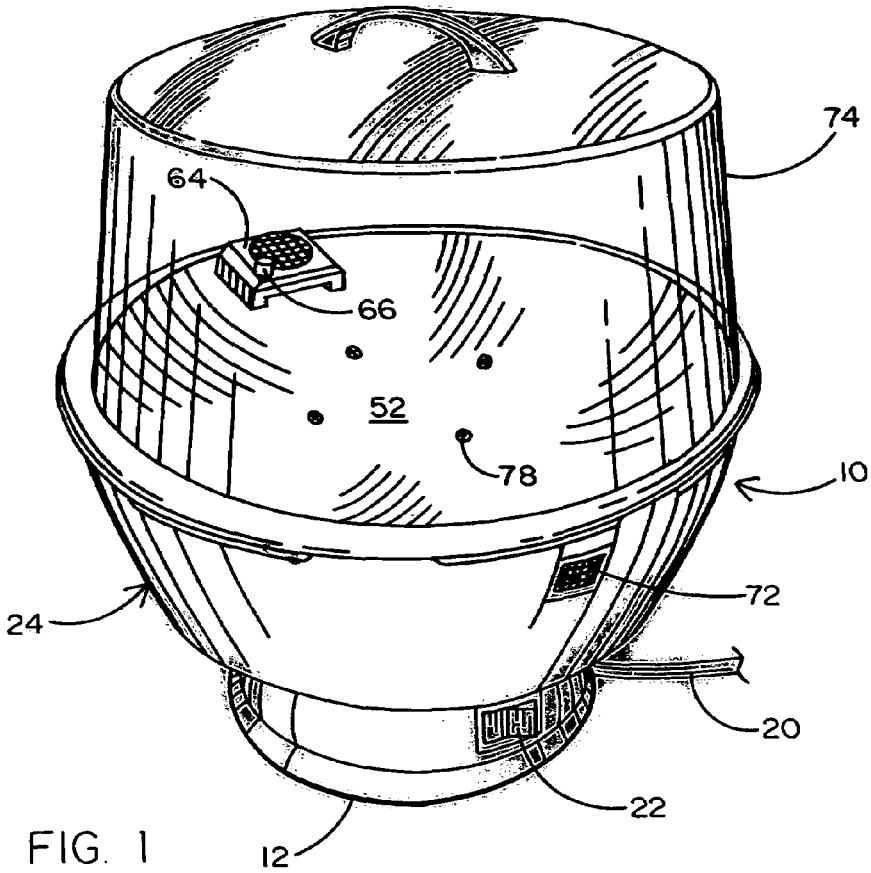
FIG. 1 is a perspective view of the fruit refrigerator of this invention.
Figure 2:
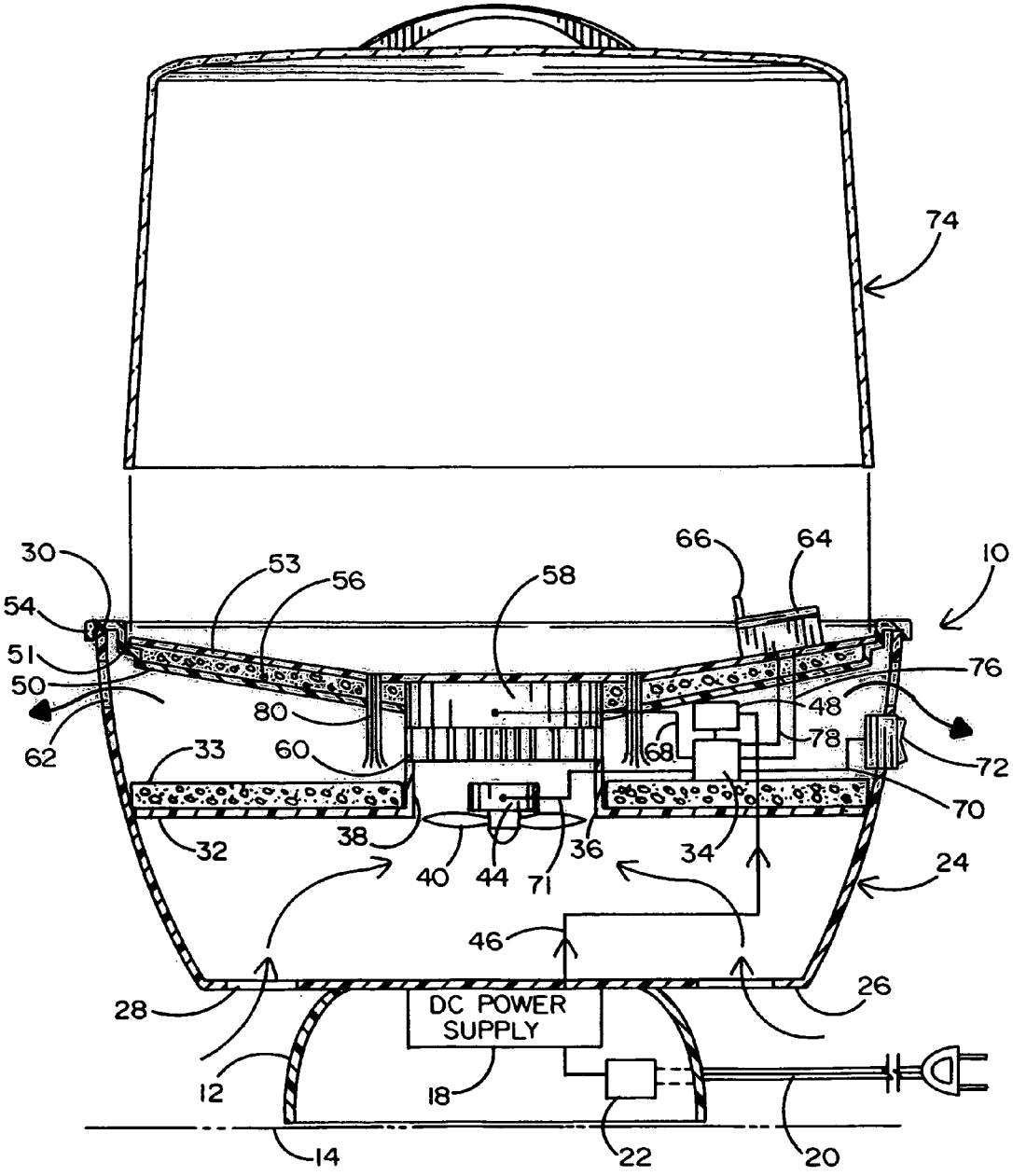
FIG. 2 is a central cross-section through the fruit refrigerator of this invention, with its dome in raised position.

The fruit refrigerator of this invention is generally indicated at 10 in FIGS. 1 and 2. In FIG. 1, the fruit refrigerator 10 is seen from the front and slightly above and is shown in perspective. In FIG. 2, the fruit refrigerator is shown substantially in a vertical centerline section. The fruit refrigerator 10 is configured to rest on a counter and has a base 12 with a flat bottom surface so that the fruit refrigerator can be placed on a countertop or table 14.

Base 12 is a hollow body of revolution about an upright axis. Internally, it contains a power supply 18. The power supply receives its power from a conventional household cord 20 which is suitable for plugin to a circuit such as a 120 volt AC circuit. Internally of the base, but available for access from the outside is an on/off switch 22 which controls the electric power supply 18. The power supply provides electric power to the cooling device, which is preferably a thermoelectric cooling unit. Such units conventionally operate on twelve volt electric power. Thus, power supply 18 supplies twelve volts DC to power line 46.

Shell body 24 is mounted on the base 12. It is also a hollow body of revolution about a central upright axis. The bottom 26 of the shell body is larger than the base 12. Cooling air inlet openings 28 are arranged about the flat bottom 26 around the outside of base 12. Partway up the shell body 24, between the bottom 26 and top edge 30, is divider 32. Divider 32 directs air flow and supports part of the interior structure. An insulating layer 33 lies on top of the divider 32. Control unit 34 is mounted on the divider 32. There is an opening 36 in the center of divider 32, and an air shroud 38 above the opening. Fan 40 and its fan motor 44 are mounted on the divider 32 within the shroud 38.

Figure 3:
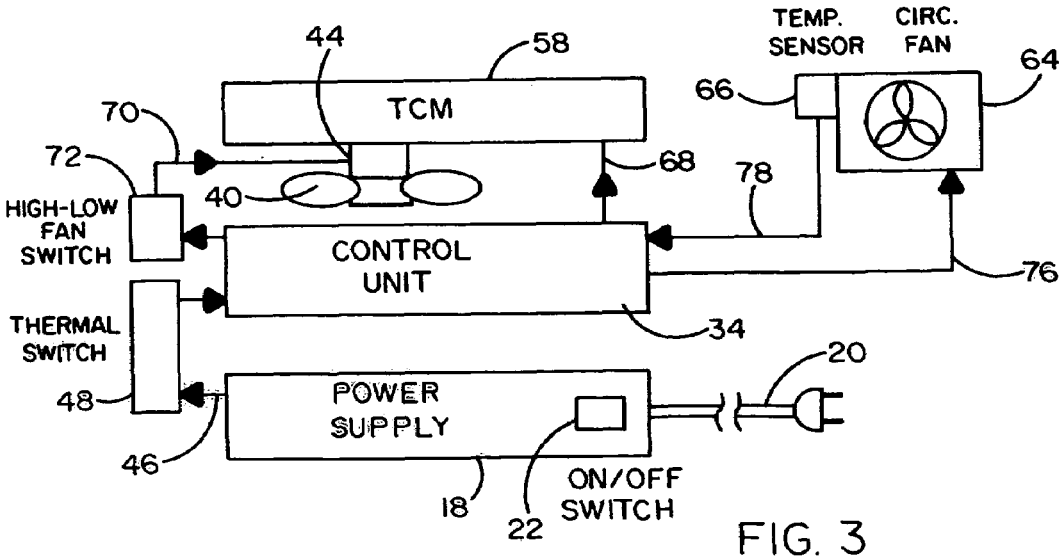
FIG. 3 is a schematic electrical diagram of the electric system in the fruit refrigerator of this invention.

Power supply 18 is connected to supply power to controller 34 through line 46. Thermal overload sensing switch 48 is serially connected in this line, see FIG. 3. When the sensed temperature indicates overheating, the power supply is shut off from the control unit 34.

Support tray 50 rests on top of shell body 24 on its top edge 30. Tray 50 is also a body of revolution. Its central axis is upright and the tray 50 is dished downward in the center. The outer edge has a down rolled lip 54 which engages over the upper edge of the shell body. Support tray 50 has a shoulder 51 which supports cold plate 53. In the space between the cold plate 53 and tray 50 is thermal insulation 56. The center downward dish 52 of the cold plate 53 is flat, and underneath the center flat section is mounted thermal electric unit 58. The thermal electric unit has downwardly extending heat exchange fins 60 which dispel heat from the thermal electric unit into the air. The fins are in the path of the air flow, which is up through air inlet openings 28 in the bottom of the body and through shroud 38, where it is propelled by fan 40. The fan drives the air flow over the fins 60. The air exits from the upper portion of the shell body through air outlet openings 62. Insulation 33 reduces the heat flow downward from this warm air into the air in the bottom of the shell body 24, thus maintaining low air temperature under the thermal electric cooling unit 58. The air outlet openings are arranged around the upper shell body near top edge 30.

Power from the control unit 34 to the thermal electric unit 58 is through line 68. This powers the thermal electric unit, which draws heat from the cold plate and rejects it downwardly out through fins 60. The control unit also supplies the fan motor 44 through line 70. High/low switch 72 is connected to the controller 34 through line 70. The controller is connected to the fan motor 44 through line 71. The high/low switch 72 permits the user to control the speed of fan 40. It would be used at high speed for initial cooling in hot weather and would be used at low speed when the cooling demands are not as great.

Domed cover 74 fits down over the cold plate and engages in the shoulder of the tray to close the space above the cold plate. The domed cover is transparent so that the materials on the cold plate may be viewed. Also mounted on the cold plate is circulating fan 64. The circulating fan 64 is within the enclosure of the dome and circulates air so that the coolness provided by the heat extraction of the thermal electric unit will be fairly uniformly circulated within the domed cover. The fan is powered from the control unit by line 76. The circulating fan 64 is always on when the switch 22 is on.

Temperature sensor 66 is in the same housing as the circulating fan 64. Therefore, the temperature sensor senses temperature which is rather indicative of the temperature inside the domed cover. The temperature sensor is connected to the control unit by line 78. When the cool set point is reached, this is signaled to the control unit, and the control unit turns off the thermal electric unit. When the temperature rises within the domed cover, this is sensed by the sensor 66, and the thermal electric unit is again actuated.

The fruit refrigerator 10 is placed at an appropriate location where it is plugged into an electric supply circuit. The on/off switch 22 is turned on. If the temperature within the dome-enclosed space is above the set point of sensor 66, the thermal electric unit 58 is energized. When the fruit placed on the tray is bananas, an appropriate temperature is 60 degrees F., to extend the shelf life of the bananas. The space is thus cooled.

When cooling occurs, there is often condensation. It is undesirable to have water accumulate on the cold plate. To preclude growth of mold and other types of spoilage, the cold plate has drain holes. Four drain holes are seen in FIG. 1, and one is indicated by the reference character 78. The drain holes are around the flat center section 52 at the outer edges thereof. Below the drain holes are wicks, one of which is indicated at 80 in FIG. 2. Instead of dripping into the mechanism, the wicks retain the moisture and position it within the outlet warm air stream. Thus, the moisture is evaporated and exhausted with the exhaust air stream before liquid can accumulate and do damage. The fruit refrigerator 10, thus holds the fruit at an optimum temperature and keeps it visible to be chosen by the consumer.

This invention has been described in its pre-ferred embodiment, and it is clear that it is susceptible to numerous modifications and embodiments within the ability of those skilled in the art and within the scope of the following claims.

What is claimed is:

1. A fruit refrigerator comprising:

a body, a cold plate supported on said body, said cold plate having a top surface and a bottom surface, a cooling device directly connected to said bottom surface of said cold plate;

a removable cover over said cold plate;

a cooling fan in said body for moving cooling air over said cooling device to remove heat from said cooling device, a power supply connected to energize said cooling fan and said cooling device;

a circulating fan adjacent said top surface of said cold plate to circulate air under said cover and only over said cold plate, said circulating fan being connected to said power supply so that when said cooling device is active, said circulating fan is energized to circulate air only above said cold plate.

2. The fruit refrigerator of claim 1 wherein said cold plate is dished to be lower in the center than adjacent its edges and said cooling device is attached to the bottom surface of said cold plate under said depressed center portion.

3. The fruit refrigerator of claim 2 wherein there is at least one hole through said cold plate in its depressed portion beside said cooling device so that condensation at said depressed center of said cold plate is strained through said cold plate.

4. The fruit refrigerator of claim 3 wherein there is a wick through said opening in said cold plate so as to wick moisture down through said cold plate, said wick being positioned in the flow of cooling air from said cooling fan and said cooling device.

5. The fruit refrigerator of claim 2 wherein said cooling device is a thermal electric cooling device, said thermal electric device having fins and said cooling fan blowing air across said fins.

6. The fruit refrigerator of claim 2 wherein said body has air inlet and air outlet holes therein and a divider through said body between said inlet and said outlet holes, said divider having an opening and said cooling fan being mounted at said opening.

7. The fruit refrigerator of claim 1 wherein said cover is a transparent cover.

8. The fruit refrigerator of claim 5 wherein there is a temperature sensor mounted on said circulating fan, said temperature sensor being connected to control said cooling device.

9. The fruit refrigerator of claim 8 wherein said power supply includes a control system connected to said temperature sensor and to said cooling device to actuate said cooling device when sensed temperature is above a set temperature.

10. The fruit refrigerator of claim 1 wherein said cold plate has a depressed center and said cooling device is mounted under said depressed center and said cold plate has at least one drain hole at its depressed center and there is a wick extending downward from said drain hole to drain moisture on said cold plate down into said body.

11. A fruit refrigerator comprising:

a body, a cold plate supported on said body, said cold plate having a depressed center portion, an electrically powered cooler mounted on the underside of said cold plate under said center portion, a drain through said depressed center section away from said electrically powered cooler to drain water down through said drain opening away from the top of said cold plate;

a circulating fan mounted above said cold plate, a transparent domed cover configured to fit over the top of said cold plate and enclose said circulating fan;

a power supply connected to said electrically powered cooler so that said electrically powered cooler is energized to cool the space under said domed cover to a selected temperature and to energize said circulating fan to circulate air enclosed by said cover.

12. The fruit refrigerator of claim 11 wherein said electric cooler is a thermal electric cooler, said thermal electric cooler having cooling fins positioned within said body, a wick extending downwardly through said opening in said cold plate, a cooling fan within said body to circulate air into said body across said cooling fins and across said wick and out of said body.

13. The fruit refrigerator of claim 12 wherein said wick extends downward into said body from said drain hole, said wick being positioned in the air stream of said cooling fan.

14. The fruit refrigerator of claim 11 wherein said electric cooler is a thermal electric cooler and said power supply is in said body and is connected to said thermal electric cooler, said power supply providing appropriate voltage and current for said thermal electric cooler, a control system powered by said power supply, a sensor being connected to said control system and said circulating fan being connected to said control system to energize said cooler, said cooling fan and said circulating fan.

15. The fruit refrigerator of claim 11 wherein there is a speed selector switch mounted on said body to be accessible from the outside of body, said speed selector switch being connected to said circulating fan so that the amount of circulating air can be selected.

16. The fruit refrigerator of claim 12 wherein both said circulating fan and said temperature sensor are mounted in the same housing and said housing is mounted on the top of said cold plate.

17. The fruit refrigerator of claim 12 wherein said drain hole through said cold plate adjacent said thermal electric unit and said wick in said drain hole are positioned so that moisture on said tray is drained through said wick adjacent said fins on said thermal electric unit so that said cooling fan blows air over said wick.

18. The fruit refrigerator of claim 11 further including a temperature sensor, said temperature sensor being positioned to sense the temperature of air being circulated by said circulating fan and wherein said power supply includes a control system connected to said temperature sensor and to said electrically powered cooler to actuate said electrically powered cooler when sensed temperature is above a set temperature.

* * * * *